US005704621A

United States Patent [19]

Lazarevich et al.

[11] Patent Number: 5,704,621

[45] Date of Patent: Jan. 6, 1998

[54] SUSPENSION SYSTEM FOR AN IN-LINE ROLLER SKATE

[76] Inventors: Ronald S. Lazarevich, 4977 Deer Creek Cir. S., Washington, Mich. 48094; Michael S. McWethy, 3663 South Blvd., Auburn Hills, Mich. 48326

[21] Appl. No.: 534,259

[22] Filed: Sep. 26, 1995

[51] Int. Cl.[6] ..... A63C 17/06

[52] U.S. Cl. ..... 280/11.28; 280/11.22

[58] Field of Search ..... 280/11.19, 11.22, 280/11.26, 11.27, 11.28, 87.03, 87.041, 724

[56] References Cited

U.S. PATENT DOCUMENTS

| | | | |
|---|---|---|---|
| 277,911 | 5/1883 | Lutz | 280/11.28 |
| 2,552,987 | 5/1951 | Loertz, Jr. . | |
| 2,576,824 | 11/1951 | Bush | 280/724 |
| 2,644,692 | 7/1953 | Kahlert . | |
| 3,649,038 | 3/1972 | Huckenbeck . | |
| 3,963,252 | 6/1976 | Carlson . | |
| 4,138,127 | 2/1979 | Kimmell et al. . | |
| 4,272,090 | 6/1981 | Wheat . | |
| 4,272,091 | 6/1981 | Reid, Jr. . | |
| 4,351,538 | 9/1982 | Berta | 280/11.26 |
| 4,728,088 | 3/1988 | Smith | 267/286 |
| 4,844,491 | 7/1989 | Wheelwright . | |
| 5,085,445 | 2/1992 | Boyden . | |
| 5,312,120 | 5/1994 | Wiegner . | |
| 5,405,156 | 4/1995 | Gonella | 280/11.22 |
| 5,486,011 | 1/1996 | Nelson | 280/11.28 |

FOREIGN PATENT DOCUMENTS

| | | | |
|---|---|---|---|
| 559179 A1 | 9/1993 | European Pat. Off. | 280/11.22 |
| 425960 | 6/1911 | France | 280/724 |
| 233545 | 4/1911 | Germany | 280/11.22 |
| 654100 | 1/1937 | Germany | 280/11.28 |

*Primary Examiner*—Robert J. Oberleitner
*Assistant Examiner*—Min Yu
*Attorney, Agent, or Firm*—Harness, Dickey & Pierce, P.L.C.

[57] ABSTRACT

A suspension system for an in-line roller skate in which the suspension system independently controls each wheel of the skate. The suspension system components for each wheel includes a swing arm that is pivotally mounted to a frame attached to a boot of the skate. The wheel is rotatably mounted on a rotation axle between opposing legs of the swing arm. Two C-shaped spring stays are secured to opposing side rails of the frame where one leg of each spring stay travels through a stand-off rigidly secured to one of the opposing legs of the swing arm. A helical spring surrounds the leg of each spring stay between the stand-off and the frame. When the wheel encounters a bump in the ground terrain, the swing arm pivots up and the helical springs are compressed between the stand-off and the frame providing shock absorption. A rebound stop prevents the swing arm from pivoting too far downward. A jounce stop prevents the swing arm from pivoting too far upward.

20 Claims, 3 Drawing Sheets

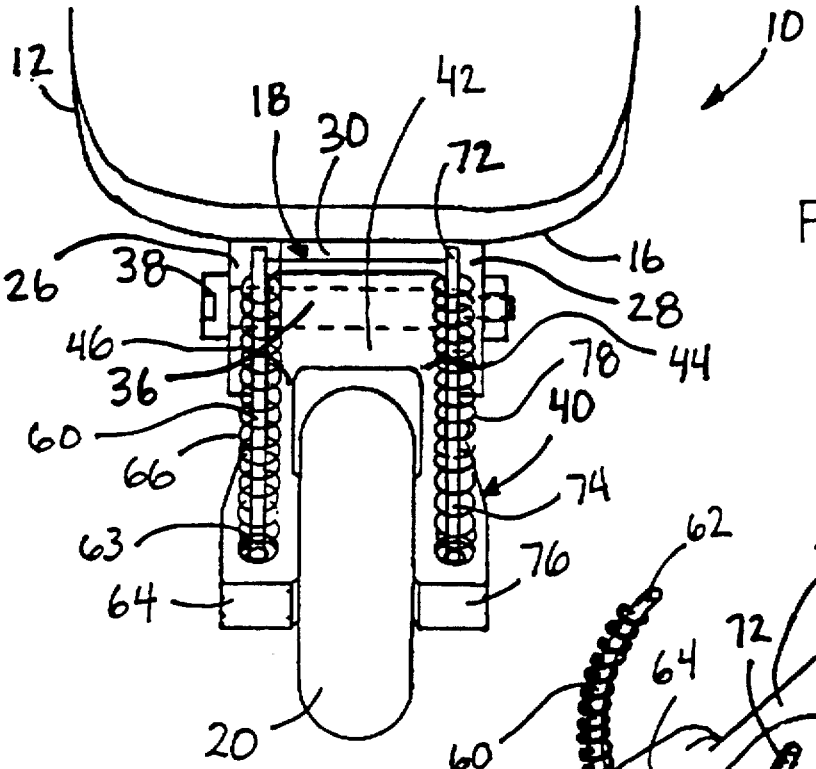
FIG. 2
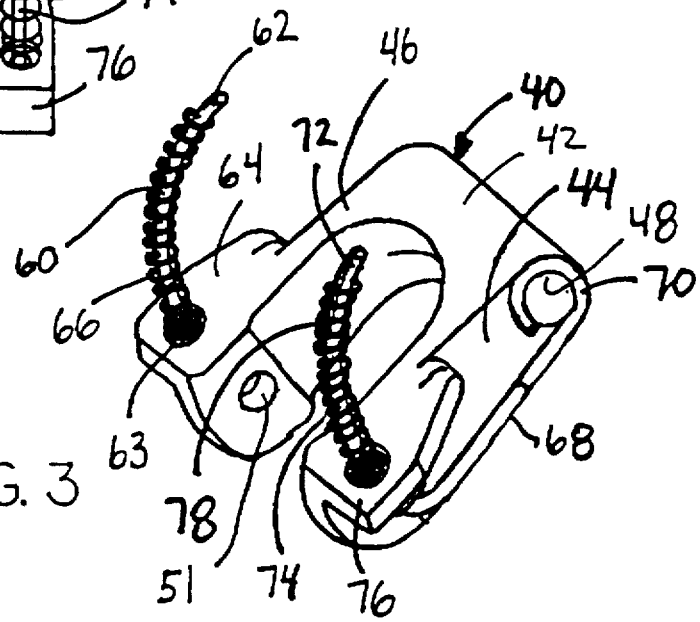
FIG. 3
FIG. 5
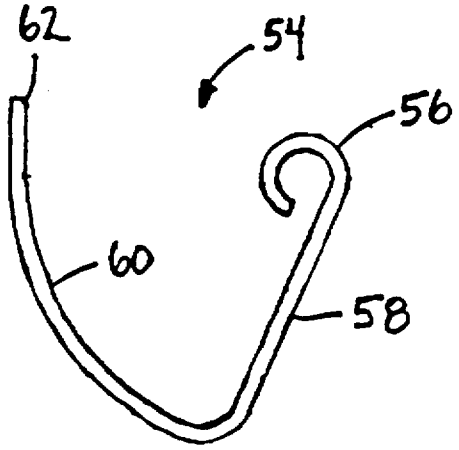
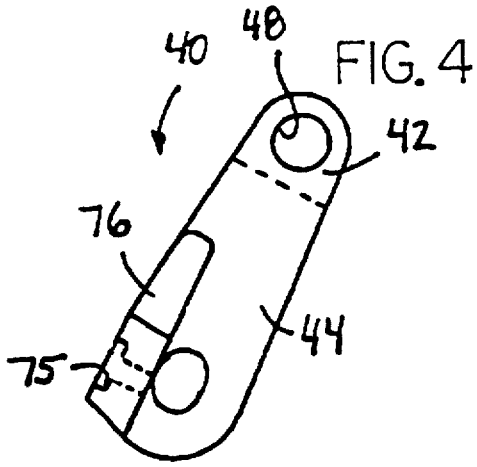
FIG. 4

SUSPENSION SYSTEM FOR AN IN-LINE ROLLER SKATE

BACKGROUND OF THE INVENTION

1. Field of the Invention

This invention relates generally to a suspension system for an in-line roller skate and, more particularly, to a suspension system for an in-line roller skate where each wheel of the skate includes a pair of helical springs for independently absorbing shocks from uneven terrain.

2. Discussion of the Related Art

Advancements in roller skate technology have produced stream-line high performance in-line roller skates where the wheels of each skate are positioned along a common center line. These types of roller skates have become very popular for many recreational and sports related activities. Many uses, especially recreational uses, of in-line roller skates include use of the skates along available outside terrain, such as roads and pedestrian sidewalks. Terrain of this nature usually is uneven, and includes bumps and edges through which the skater must navigate.

Current commercially available in-line roller skates are not equipped with any type of shock absorbing or suspension system which would lessen the impact of the roller skates contacting the obstacles through rough and bumpy terrain. Generally, the wheels of an in-line roller skate are rigidly secured to a frame attached to a boot of the skate. Therefore, shock applied to the skate as the skater encounters the different obstacles along the terrain is directly transferred to the skater. Consequently, a skater may encounter uncomfortable and possibly dangerous jolts as a result of impact along the uneven terrain.

U.S. Pat. No. 5,330,208 issued to Charron et al. discloses a shock absorber for an in-line roller skate. The Charron et al shock absorber utilizes various types of shock absorbing mechanisms, including compression coil springs, and resilient shock absorbing discs. The compression springs or discs are positioned between an axle on which the individual wheels of the skate are secured and a frame member attached to a boot of the skate. The shock absorbing discs can be of various shapes and can be made of different resilient materials.

Although Charron et al. provides certain shock absorbing techniques for in-line skates, there is still room for improvement in this area. It is therefore an object of the present invention to provide a productively feasible and effective suspension system for an in-line roller skate.

SUMMARY OF THE INVENTION

In accordance with the teachings of the present invention, a suspension system for an in-line roller skate is disclosed that independently controls each wheel of the skate. In one embodiment, the suspension system components for each wheel includes a swing arm that is pivotally mounted to a frame attached to a boot of the in-line skate. The wheel is rotatably mounted on a rotation axle between opposing legs of the swing arm. Two C-shaped spring stays are secured to opposing side-rails of the frame where one leg of each spring stay travels through separate stand-offs rigidly secured to the swing arm. A helical spring surrounds the leg of each spring stay between the stand-off and the frame. When the wheel encounters a bump in the ground terrain, the swing arm pivots up, and the helical springs are compressed between the stand-offs and the frame providing shock absorption. A jounce stop prevents the swing arm from pivoting too far upward and a rebound stop prevents the swing arm from pivoting too far downward.

Additional objects, advantages, and features of the present invention will become apparent in the following description and appended claims, taking in conjunction with the accompanying drawings.

BRIEF DESCRIPTION OF THE DRAWINGS

FIG. 2 shows a back view of the in-line skate shown in FIG. 1;

FIG. 3 shows a perspective view of a swing arm, two spring stays, and two helical springs associated with the suspension system of the invention;

FIG. 4 shows a side view of the swing arm of FIG. 3 separated from the spring stay and helical springs;

FIG. 5 shows a side view of the spring stay shown in FIG. 3 separated from the swing arm;

DETAILED DESCRIPTION OF THE PREFERRED EMBODIMENTS

The following discussion of the preferred embodiments directed to a suspension system for an in-line roller skate is merely exemplary in nature and is in no way intended to limit the invention or its applications or uses.

Figure 1:
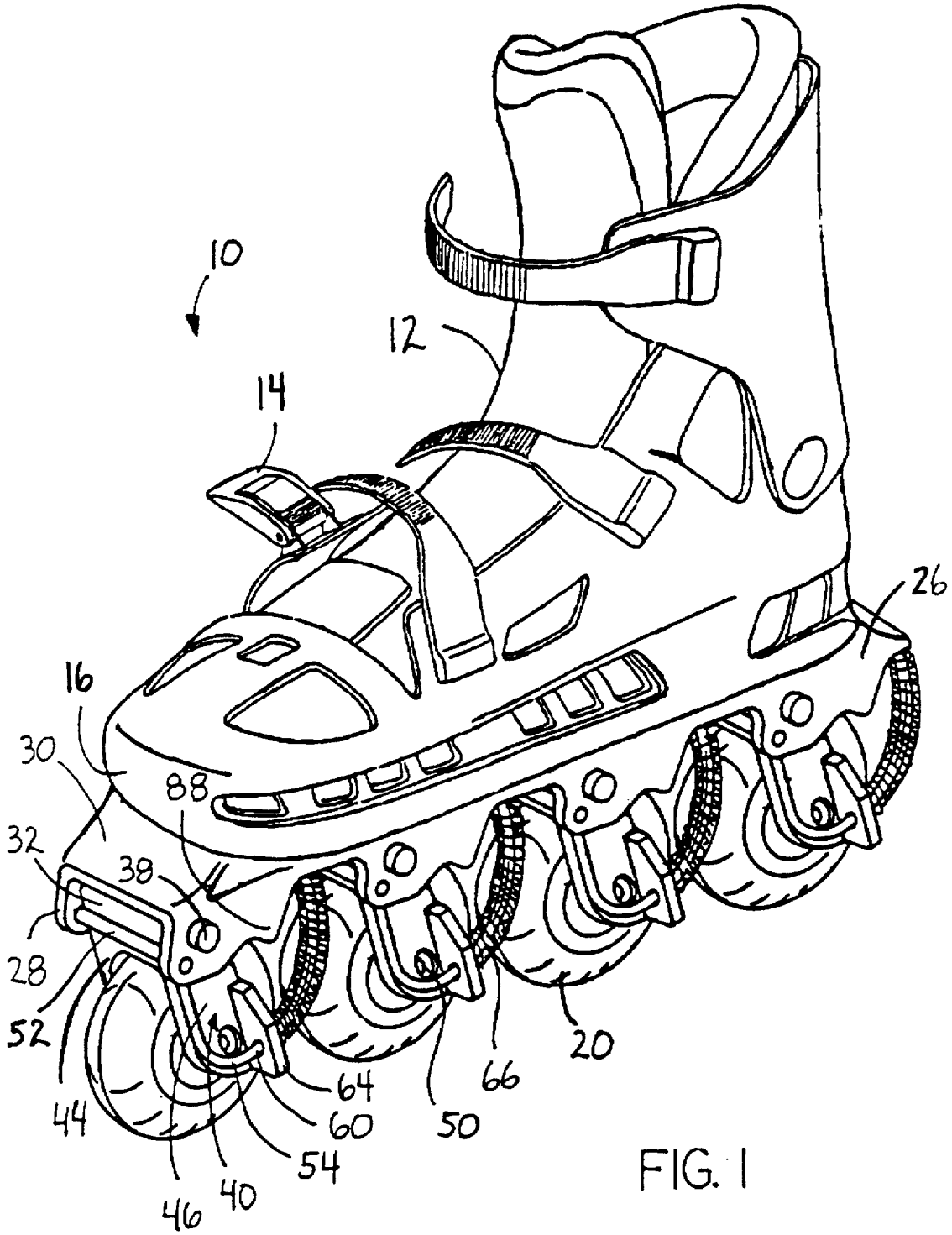
FIG. 1 shows a perspective view of an in-line skate including a suspension system according to an embodiment of the present invention.

FIG. 1 shows a perspective view and FIG. 2 shows a back view of an in-line roller skate 10 including a suspension system according to an embodiment of the present invention. Only one in-line roller skate is depicted here, but it will be understood that in-line roller skates generally come in pairs. The in-line skate 10 includes a boot 12, typically made of a molded plastic, that is configured to hold a human foot (not shown), as it is well understood in the art. A series of boot buckles 14 secure the foot within the boot 12. The boot 12 is intended to represent any style and shape of boot known in the art of in-line roller skates for purposes of the present invention. The boot 12 includes a bottom surface 16 that is rigidly secured to a frame 18 that extends the length of the boot 12. In one embodiment, the frame 18 is made of a metal, such as aluminum, and is formed into a desirable shape by a machining process, or other suitable metal forming process. However, the frame 18 can be made of a plastic material that may or may not be integrally molded with the boot 12, as well as other types of materials and styles, and be within the scope of the invention.

A series of wheels 20 are secured to the frame 18 by the suspension system of the invention, in a manner that will become apparent from the discussion below, along a common centerline. The wheels 20 are known in-line skate wheels that are made of any known applicable material, such as a synthetic rubber, suitable for the purposes of in-line skating. In this example, the in-line skate 10 includes four wheels 20 secured to the frame 18. However, other types of in-line skates may incorporate different numbers of wheels, such as three wheels, or possibly five wheels, depending on the particular design of the skate. The suspension system of the present invention can be extended to any number of wheels associated with an in-line skate. As will be described in detail below, the suspension system of the invention provides shock absorbing characteristics to each wheel 20 independently of the other wheels 20 of the skate 10. In another words, as the skate 10 travels over an uneven terrain, bumps in the terrain may independently affect the wheels 20. The suspension system of the invention allows each wheel 20 to move separately from the remaining wheels to appropriately absorb the shock of the bumps while at the same time keeping the wheels in contact with the ground for control purposes.

As mentioned above, the suspension system of the invention independently suspends each of the wheels 20 so that the wheels 20 move independently relative to the frame 18 to absorb shock. With this in mind, the discussion below of the suspension system of the invention will only describe the suspension system components, of one wheel 20 with the understanding that the remaining wheels 20 have identical components and features. Further, it will also be understood from the discussion below that the suspension system of the invention has right-side and left-side symmetry in that the components on one side of the skate 10 can be found on the other side of the skate 10.

The frame 18 includes a left-side rail 26 and a right-side rail 28 extending down from a platform 30 to form a channel 32 along the length of the boot 12, as shown. The platform 30 of the frame 18 is secured to the bottom surface 16 of the boot 12 by a suitable fastening mechanism such as bolts. A shoulder bolt 36 extends across the channel 32, and is secured to the opposing side rails 26 and 28. A swing arm 40 is pivotally mounted on the shoulder bolt 36 between the side rails 26 and 28 within the channel 32. In this manner, the shoulder bolt 36 acts as a pivot axle providing a bearing surface on which the swing arm 40 pivots. The shoulder bolt design prevents the side rails 26 and 28 from moving together and binding the swing arm 40. Other types of pivot axles other than the shoulder bolt 36 can also be used within the scope of the invention. FIG. 3 shows a perspective view and FIG. 4 shows a side view of the swing arm 40 separated from the skate 10. The swing arm 40 includes a base portion 42, opposing leg portions 44 and 46, and a bore 48 through the base portion 42 that accepts the shoulder bolt 36 in a pivotal engagement. The swing arm 40 is provided as a one piece unit made of a suitable metal, such as aluminum, or a molded or machined plastic. The swing arm 40 is provided as a one piece unit so as to distribute force evenly from side to side of the swing arm 40, and prevent the swing arm 40 from binding.

The opposing leg portions 44 and 46 of the swing arm 40 extend down from the channel 32. A rotation axle 50 is rigidly secured between the opposing leg portions 44 and 46 opposite to the base portion 42. The rotation axle 50 extends through a bore 51 through the leg portions 44 and 46. The wheel 20 is rotatably mounted on the rotation axle 50 between the opposing leg portions 44 and 46, as shown. In this manner, the wheel 20 is free to rotate relative to the swing arm 40, and the swing arm 40 is free to pivot on the shoulder bolt 36 relative to the frame 18.

A rebound stop 52 is rigidly secured to the opposing side rails 26 and 28, and extends across the channel 32 just in front of and below the shoulder bolt 36 as shown. The rebound stop 52 acts as a stop for the swing arm 40 such that the pivoting motion of the swing arm 40 is limited in its downward travel by the rebound stop 52. This is important in preventing the wheel 20 from travelling too far downward after it recovers from an encounter with a bump in the terrain, as will become more apparent from the continuing discussion below. In the rest or preloaded position, edges of the opposing leg portions 44 and 46 rest against the rebound stop 52.

A left-side spring stay 54 is secured to the frame 18 as shown. FIG. 5 shows a side view of the spring stay 54 separated from the skate 10. In one embodiment, the spring stay 54 is a round, spring-steel curvilinear member. However, the spring stay 54 can be made of other materials, such as plastic, having other shapes. The left-side spring stay 54 has an open end 56 that is rigidly secured to the shoulder bolt 36 adjacent to the side-rail 26 within the channel 32. The spring stay 54 includes a downwardly extending leg portion 58 and an upwardly extending curved leg portion 60 that gives the spring stay 54 a general C-shape. An opposite end 62 of the spring stay 54 is secured within a suitably configured opening 61 (see FIGS. 6 and 7) in a bottom surface (not shown) of the platform 30. The curved leg portion 60 extends through an opening 63 in a standoff 64 that is integrally formed on the leg portion 46 of the swing arm 40. A helical spring 66 is positioned around the leg portion 60 between the standoff 64 and the bottom surface of the platform 30, as shown. In one embodiment the helical spring 66 has a rectangular cross-section so as to store more energy for shock absorbing purposes. Of course, as will be appreciated by those skilled in the art, other cross-sections of the spring 66 will be applicable. Further, other types of biasing members can also be incorporated to provide the shock absorption.

Likewise, as best shown in FIG. 3, a right-side spring stay 68 includes one end 70 connected to the shoulder bolt 36 adjacent to the right-side rail 28 within the channel 32, and an opposite end 72 secured within a suitably configured opening in the bottom surface of the platform 30. A curved leg portion 74 of the right-side spring stay 68 extends through an opening 75 of a stand-off 76 that is integrally formed on the leg portion 44 of the swing arm 40. A helical spring 78, identical to the helical spring 66, is positioned around the curved leg portion 74 of the spring stay 68 between the stand-off 76 and the bottom surface of the platform 30.

Figure 6:
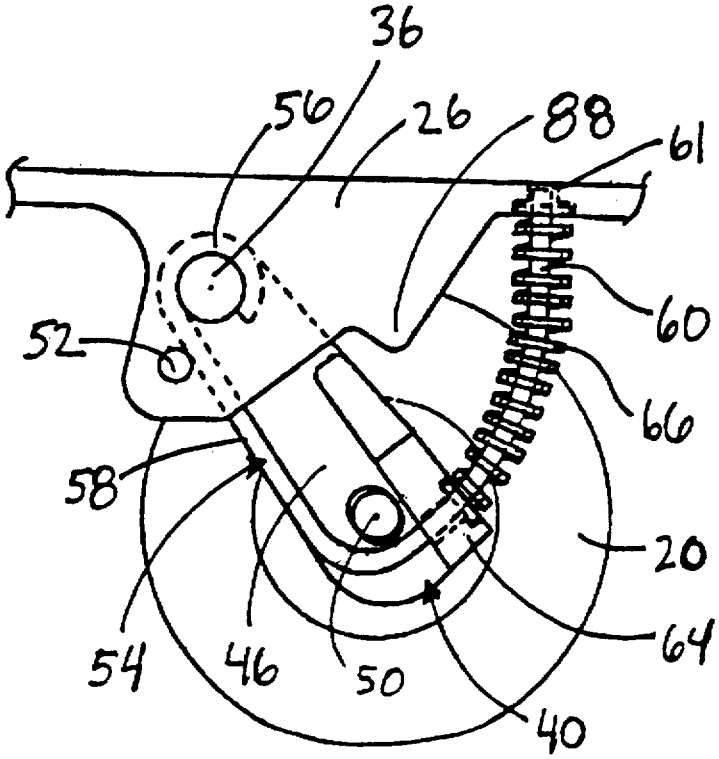
FIG. 6 shows a cut-away side view isolating a single wheel of the in-line skate of FIG. 1 when the wheel is in a preloaded state.
Figure 7:
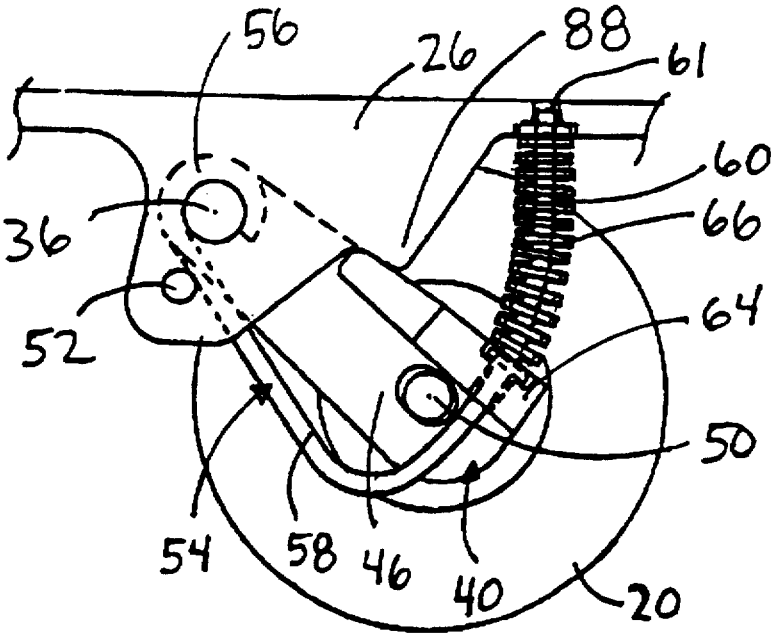
FIG. 7 shows a cut-away side view isolating the same wheel as FIG. 6 when the wheel is in a loaded state.

FIGS. 6 and 7 show the operation of the suspension system of the invention for the wheel 20 isolated from the remaining wheels, as the wheel 20 travels over uneven ground terrain. FIGS. 6 and 7 show left-side views with the understanding that the right-side operates in the same manner. FIG. 6 shows the wheel 20 in the preloaded position along even ground terrain where the swing arm 40 is positioned against the rebound stop 52. When the wheel 20 encounters a bump in the terrain, the wheel 20 is forced up towards the frame 18 as the swing arm 40 pivots on the shoulder bolt 36. As the swing arm 40 pivots, the standoff 64 is forced against the spring 66 causing the spring 66 to compress. Also, as the swing arm 40 pivots, the stand-off 76 is forced against the spring 78 causing the spring 78 to compress. As the travel of the wheel 20 continues, the springs 66 and 78 are under greater compression and act to slow down the pivot of the wheel 20. This action provides the desirable shock absorbing characteristics.

If the force of the impact with the bump is great enough, the standoff 64 will eventually contact a jounce stop 88 formed in the side rail 26 that prevents continuing pivotal movement of the swing arm 40 on the shoulder bolt 36. The stand-off 76 will also contact a jounce stop (not shown) formed in the side rail 28 on the right-side of the skate 10. Therefore, the travel of the swing arm 40 is limited between the rebound stop 52 and the jounce stop 88. After the wheel 20 has moved over the bump, the swing arm 40 will pivot back on the axle 36 under the compression force of the springs 66 and 78 until the swing arm 40 contacts the rebound stop 52. As is apparent from this description, each of the wheels 20 of the skate 10 can independently respond to bumps in the ground terrain.

In one embodiment, the compression of the eight helical springs for a four wheel in-line skate is selected to support a 200 pound man without causing the swing arms associated with any of the wheels 20 to pivot, and thus all of the swing arms will be positioned against their associated rebound stops in the rest state. In this embodiment, each of the eight springs when installed will support 25 pounds each. Each spring is ⅜ of an inch in diameter by 2½ inches long with a spring rate of 38.7 pounds per inch. It is stressed, however, that these springs are used by way of a non-limiting example in that the helical springs can be replaced by other springs having different compression forces for different individuals.

The suspension system as just-described is effectively adaptable to current in-line skates technology. The suspension system of the invention includes a minimal number of parts to minimize cost, and is easily assembled and disassembled to allow for service. Further, the suspension system of the invention adds a minimal weight to already existing in-line skates, adds a minimal height to the overall height of current in-line skates, and does not interfere with current maximum rotational tilt of present day skates.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A suspension system used with an in-line roller skate, said suspension system being attached to the in-line skate, said in-line skate including a frame structure, said frame structure supporting at least one wheel, said suspension system comprising:

a swing arm pivotally attached to the frame structure, said swing arm including at least one stand-off, said at least one wheel being rotatably secured to the swing arm;

at least one spring stay, said spring stay extending through the standoff, said spring stay being an elongated curvilinear member having a first end secured to the frame structure and a second end secured to the frame structure; and at least one spring member positioned on the at least one spring stay such that the spring stay travels through the spring member, said spring member being forced into compression between the stand-off and the frame structure when the at least one wheel pivots towards the frame structure on the swing arm.

2. The suspension system according to claim 1 further comprising a rebound stop, said rebound stop being secured to the frame structure and preventing downward travel of the swing arm beyond a predetermined position when the swing arm contacts the rebound stop.

3. The suspension system according to claim 1 wherein the frame structure includes at least one jounce stop, said jounce stop limiting the travel of the swing arm when the swing arm pivots up towards the frame structure and the swing arm contacts the jounce stop.

4. The suspension system according to claim 1 wherein the at least one spring member is a helical spring having a rectangular cross-section.

5. The suspension system according to claim 1 wherein the swing arm is a one-piece unit having a base portion pivotally secured to the frame structure and first and second opposing legs, wherein the at least one wheel is positioned between the first and second opposing legs in the rotational engagement.

6. The suspension system according to claim 5 wherein the swing arm is secured to the frame structure by a pivot axle that extends through the base portion of the swing arm, said pivot axle being mounted to the frame structure.

7. The suspension system according to claim 1 wherein the at least one spring stay is a general C-shaped member.

8. The suspension system according to claim 1 wherein the at least one spring stay is a first and second spring stay, and the at least one spring member is a first and second spring member, said first spring member being positioned on the first spring stay at one side of the frame structure adjacent to a right leg portion of the swing arm and the second spring member being positioned on the second spring stay at an opposite side of the frame structure adjacent to a left leg portion of the swing arm.

9. A suspension system used with an in-line roller skate, said suspension system being attached to the roller skate, said in-line skate including a frame structure secured to a bottom area of a boot of the skate, said frame structure supporting a plurality of wheels, said suspension system being separated into sub-suspension systems for each wheel, said sub-suspension systems comprising:

a swing arm pivotally attached to the frame structure, said swing arm including a base portion, and opposing first and second leg portions, said swing arm including a first stand-off being secured to the first leg portion and a second stand-off being secured to the second leg portion, wherein a wheel is rotatably secured on a rotating axle between the opposing leg portions;

a first spring stay extending through the first stand-off and a second spring stay extending through the second stand-off, said first and second spring stays being elongated curvilinear members, wherein a first end and a second end of the first spring stay are secured to the frame structure in relation to a first side rail connected to and running along the length of one side of the frame structure and a first end and a second end of the second spring stay are secured to the frame structure in relation to a second side rail connected to and running along the length of an opposite side of the frame structure; and a first spring member positioned on the first spring stay such that the first spring stay travels through the first spring member and a second spring member positioned on the second spring stay such that the second spring stay travels through the second spring member, said first spring member being forced into compression between the first stand-off and the frame structure and said second spring member being forced into compression between the second stand-off and the frame structure when the wheel pivots up towards the frame structure on the swing arm under the influence of a driving force applied to the wheel, wherein each wheel of the skate independently responds to the driving forces.

10. The suspension system according to claim 9 wherein each sub-suspension system further comprises a rebound stop, said rebound stop being secured to the frame structure between the first and second side rails, said rebound stop preventing downward pivotal travel of the swing arm beyond a predetermined position when the swing arm contracts the rebound stop.

11. The suspension system according to claim 9 wherein each sub-suspension system further comprises a first side jounce stop secured to the first side rail of the frame structure and a second side jounce stop secured to the second side rail of the frame structure, said first side jounce stop and said second side jounce stop limiting the travel of the swing arm when the swing arm pivots up towards the frame structure and the swing arm contacts the first side and second side jounce stops.

12. The suspension system according to claim 9 wherein the first and second spring members are helical springs having a rectangular cross-section.

13. The suspension system according to claim 9 wherein the base portion and the first and second opposing leg portions of the swing arm are integrally formed such that the swing arm is a one-piece unit.

14. The suspension system according to claim 9 wherein each sub-suspension system further comprises a pivot axle positioned between the first side rail and the second side rail of the frame structure, said swing arm being pivotally attached to the pivot axle.

15. The suspension system according to claim 9 wherein the first spring stay and the second spring stay are general C-shaped members.

16. A suspension system used with an in-line roller skate, said suspension system being attached to the roller skate, said in-line roller skate including a frame structure secured to a bottom area of a boot of the skate, said frame structure including a base portion attached to the boot and a first side rail and a second side rail extending down from the base portion and being substantially parallel to each other to form a channel therebetween, said frame structure supporting a plurality of wheels of the skate, said suspension system being separated into subsuspension systems for each wheel, each of the subsuspension systems comprising:

a pivot axle rigidly secured to the first and second side rails and extending across the channel;

a swing arm pivotally attached to the pivot axle, said swing arm including a base portion having a bore through which the pivot axle extends, and opposing first and second leg portions, said swing arm further including a first stand-off secured to the first leg portion and a second stand-off secured to the second leg portion, wherein a wheel is rotatably secured on a rotation axle between the first and second opposing leg portions;

a first spring stay and a second spring stay, said first and second spring stays being curvilinear members, wherein a first end of the first spring stay is secured to the pivot axle proximate to the first side rail of the frame structure and a second end of the first spring stay is secured to the base portion of the frame structure, and a first end of the second spring stay is secured to the pivot axle adjacent to the second side rail of the frame structure and a second end of the second spring stay is secured to the base portion of the frame structure;

a rebound stop secured to the first and second side rails within the channel in front of and below the pivot axle;

a first jounce stop positioned on the first side rail and a second jounce stop positioned on the second side rail; and a first spring member positioned on the first spring stay between the first stand-off and the frame structure and a second spring member positioned on the second spring stay between the second stand-off and the frame structure, said first spring member being forced into compression between the first stand-off and the frame structure and the second spring member being forced into compression between the second stand-off and the frame structure where the wheel pivots up towards the frame structure on the swing arm under the influence of a driving force applied to the wheel, said first and second jounce stops preventing the swing arm from pivoting beyond a predetermined position when the swing arm contracts the first and second jounce stops, wherein each wheel of the skate independently responds to driving forces.

17. The suspension system according to claim 16 wherein the base portion, the first and second opposing leg portions, and the first and second stand-offs of the swing arm are integrally formed such that the swing arm is a one-piece unit.

18. The suspension system according to claim 16 wherein the first and second spring members are helical springs having a rectangular cross-section.

19. The suspension system according to claim 16 wherein the pivot axle is a shoulder bolt.

20. The suspension system according to claim 16 wherein the first spring stay and the second spring stay are general C-shaped members.

* * * * *

UNITED STATES PATENT AND TRADEMARK OFFICE

CERTIFICATE OF CORRECTION

PATENT NO. : 5,704,621

DATED : January 6, 1998

INVENTOR(S) : Ronald S. Lazarevich et al.

It is certified that error appears in the above-identified patent and that said Letters Patent is hereby corrected as shown below:

Column 8, line 24, please delete "where" and insert --when--.

Signed and Sealed this

Ninth Day of June, 1998

*Attest:*

*Attesting Officer*

BRUCE LEHMAN

*Commissioner of Patents and Trademarks*